United States Patent [19]

Patterson, II

[11] 4,419,061

[45] Dec. 6, 1983

[54] MULTI-PIECE ROTARY ATOMIZER DISK

[75] Inventor: Robert J. Patterson, II, Port St. Lucie, Fla.

[73] Assignee: United Technologies Corporation, Hartford, Conn.

[21] Appl. No.: 453,189

[22] Filed: Dec. 27, 1982

[51] Int. Cl.[3] ..... B28B 1/54

[52] U.S. Cl. ..... 425/8; 264/8

[58] Field of Search ..... 425/8; 264/8

[56] References Cited

U.S. PATENT DOCUMENTS

| | | | |
|---|---|---|---|
| 2,062,093 | 11/1936 | Kann | 425/10 |
| 4,178,335 | 12/1979 | Metcalfe et al. | 264/8 |
| 4,207,040 | 6/1980 | Metcalfe et al. | 425/8 |
| 4,310,292 | 1/1982 | Carlson et al. | 425/8 |

FOREIGN PATENT DOCUMENTS 754180 8/1956 United Kingdom .

*Primary Examiner*—James R. Hall

*Attorney, Agent, or Firm*—Stephen E. Revis

[57] ABSTRACT

An atomizer disk for use in the process of making metal powder by pouring molten metal onto the spinning disk is made from a plurality of contiguous, concentric, radially aligned elements having thermal conductivity properties which are selected to achieve appropriate temperature zones on the surface of the disk during operation. The central disk-like element is preferably a ceramic with low thermal conductivity. The outermost element is a high strength reinforcing ring which preferably also has high thermal conductivity. The annular elements between the outer ring and central disk should also have high thermal conductivity. By properly selecting the disk materials the heat extraction from the molten metal can be better controlled and larger disks may be constructed.

8 Claims, 2 Drawing Figures

MULTI-PIECE ROTARY ATOMIZER DISK

DESCRIPTION

1. Technical Field

This invention relates to rotary atomization apparatus for producing metal powders from molten metals.

2. Background Art

It is well known in the art to form metal powders by pouring molten metal onto the surface of a spinning disk which flings the molten metal, in the form of very small droplets, outwardly into a quenching chamber. The body of the spinning disk is typically made from a high strength, high thermal conductivity metal which can withstand the centrifugal loads at the high rotational speeds and temperatures to which it will be subjected. Typical prior art atomizer disks are shown in FIG. 3 of British Patent Specification No. 754,180 filed Aug. 13, 1954. That disk is made from a solid disk of carbon or graphite onto which the molten metal (aluminum in that case) is poured. The carbon disk is surrounded by a metal chuck to prevent bursting of the disk at high rotational speeds.

Other atomizer disk constructions are shown and described in commonly owned U.S. Pat. Nos. 4,178,335; 4,207,040; and 4,310,292. In those patents the atomizer disks comprise a solid copper disk having a concave upper surface which has been coated with a layer of ceramic. An annular ring of metal surrounds the upper edge of the copper disk and acts as a holder for the ceramic layer which might otherwise fail under high centrifugal loadings. The ring has an upper surface which is coextensive with the top surface of the ceramic layer but which is not coated with ceramic. An object of those atomizer disk constructions is to form during operation, a solid skull on the surface of the atomizer disk, the skull being made from the metal being atomized. The skull provides a wettable surface over which the molten metal flows during atomization. Heat is conducted away from the molten metal in the vicinity of the uncoated upper surface of the ring thereby resulting in increased skull thickness around the periphery of the disk.

Other U.S. patents which show the state-of-the-art of the atomizer disks are: U.S. Pat. Nos. 2,062,093; 2,439,776; and 2,439,772.

It is believed that increasing the diameter of the atomizer will reduce the mean particle size of the powder produced, which may be desirable in certain instances. On the other hand, it is believed that a larger diameter will permit an increase in the rate at which molten metal can be poured onto the disk without increasing the particle size of the powder produced. The obtaining of either benefit is dependent upon properly controlling disk conditions, in particular the temperature over the upper surface of the atomizer disk. It is not believed that this can be done properly using atomizer disks designed according to the prior art.

DISCLOSURE OF INVENTION

One object of the present invention is an atomizer disk having improved thermal properties.

Another object of the present invention is an atomizer disk which may have its thermal properties tailored to achieve improved performance during operation.

A further object of the present invention is an atomizer disk which can be of larger diameter than prior art disks.

According to the present invention an atomizer disk is made from contiguous, concentric, radially aligned elements made from a plurality of materials having different thermal conductivity properties, including an outermost reinforcing ring of high strength material.

The materials for the concentric disk elements are selected in order to achieve appropriate temperature zones on the upper surface of the atomizer disk during operation. The central disk element is made from a low thermal conductivity material such as ceramic, while surrounding annular elements are made from high thermal conductivity material, e.g., metals.

During operation of an atomizer, heat is continuously extracted from the molten metal as it moves over the surface of the atomizer disk from its center to its periphery. The larger the disk, the greater the surface area and also the greater the residence time of the metal on the disk such that much more heat is extracted as compared to smaller disks. It is necessary that the pour temperature of the molten metal be high enough relative to the rate at which heat is extracted to ensure that the molten metal temperature will be sufficiently high throughout its travel over the atomizer disk surface (i.e., remains molten at least until it leaves the surface).

One possible method for compensating for the additional heat loss associated with larger diameter disks is to increase the pour temperature of the molten metal. This may, however, be undesirable since higher temperatures create greater stresses on the disk. Also, the hotter the molten metal the greater the likelihood that it will react with disk materials or erode the surface of the disk.

In the present invention the central portion of the disk is preferably ceramic which minimizes heat loss in an axial direction (i.e., in the direction of the axis of rotation) through that central portion. The immediately surrounding (i.e., radially adjacent) disk element is made from a high thermal conductivity material which conducts heat away from the surface of the atomizer disk much more quickly than the ceramic portion. The material and size of this element is preferably selected to reduce molten metal temperatures to form and control the formation of a metal skull on the surface of the atomizer disk.

The atomizer disk also includes an outer annular ring of high tensile strength material. This ring provides strength to the disk to prevent it from bursting during operation. In a preferred embodiment the upper surface of the ring is a part of the upper surface of the atomizer disk over which the molten metal flows. It can thus also be used to control molten metal temperature at the outer edge of the atomizer disk upper surface.

The foregoing and other objects, features and advantages of the present invention will become more apparent in the light of the following detailed description of preferred embodiments thereof as shown in the accompanying drawing.

BEST MODE FOR CARRYING OUT THE INVENTION

Figure 1:
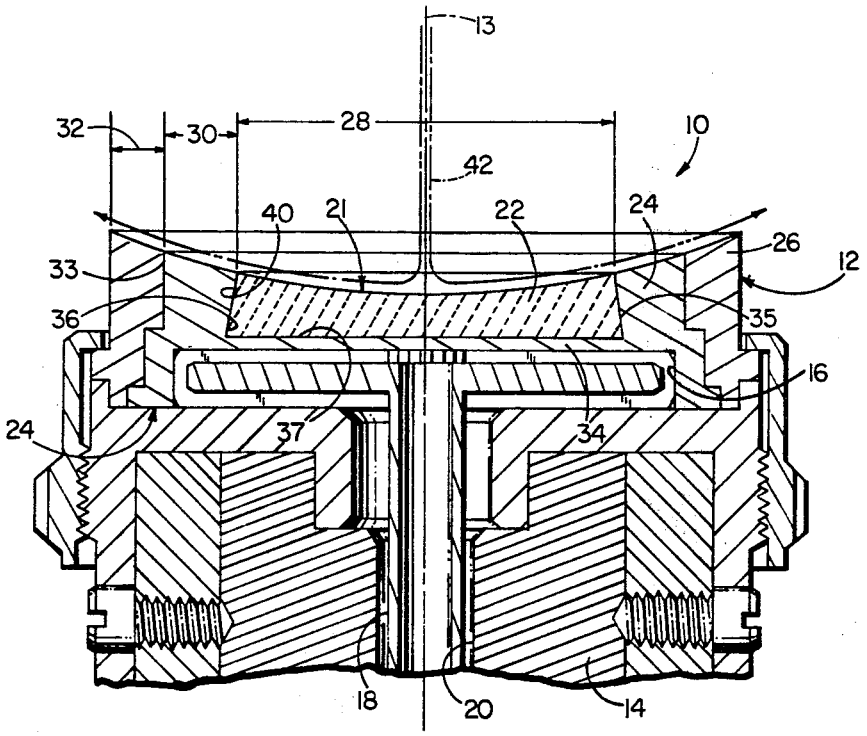
FIG. 1 is a sectional view of the upper portion of rotary atomization apparatus according to the present invention.

FIG. 1 shows an exemplary embodiment of rotary atomization apparatus 10 having a disk 12 in accordance with the teachings of the present invention. The disk 12 is mounted on a drive shaft 14 by suitable means which may be similar to the means shown in hereinabove referred to commonly owned U.S. Pat. No. 4,178,335 which is incorporated herein by reference. The disk 12 rotates about an axis 13. The means for mounting the disk 12 on the drive shaft is not considered to be a part of the present invention and is not shown in detail. An electric motor or air turbine may be used to rotate the drive shaft at high speeds of over 10,000 RPM, preferably greater than 20,000 RPM.

The disk 12 includes a cylindrical coolant compartment 16 into which a coolant fluid, such as water, is pumped during operation, such as through a hollow tube 18. Heated coolant leaves the compartment 16 through an annular space 20 between the tube 18 and the drive shaft 14. Further details of apparatus and means for carrying coolant to the disk 12 may be found in commonly owned U.S. Pat. No. 4,140,462 which is incorporated herein by reference; however, the actual means for carrying coolant to and away from the disk 12 is not considered to be a part of the present invention.

In accordance with the present invention, the disk 12 has an uper atomizer surface 21 which, in this instance, is spherical and concave, although it could also be a horizontal, flat surface or have a symmetrical curvature other than spherical. The disk 12 is made from three separate concentric elements 22, 24, and 26 defining three contiguous, concentric, radially aligned zones 28, 30, and 32, respectively, of disk material. The upper surfaces of the zones 28, 30, 32 define the atomizer surface 21. Each element 22, 24, 26 includes at least one annular surface extending downwardly from the upper surface 21 and which is contiguous with one of said annular surfaces of an adjacent element, such as at the interfaces 33 and 35. Although not shown in the drawing, the upper surface of each element 24, 26 is coated with a thin layer of ceramic to protect it against erosion. As discussed hereinbelow, the central element 22 is likely to be solid ceramic.

The central element 22 is generally circular in cross section and is made from low thermal conductivity material. The surrounding elements 24, 26 are made from high thermal conductivity material. For purposes of the present invention, low thermal conductivity means a thermal conductivity less than 0.1 W/cm°K. at a temperature of 1000° K. High thermal conductivity means a thermal conductivity greater than 0.1 W/cm°K. at 1000° K. The element 24 between the central element 22 and outermost element 26 most preverably has a thermal conductivity greater than 1.0 W/cm°K.

The outermost element 26 is primarily a reinforcing ring and must have high tensile strength to prevent the disk 12 from bursting during operation. High tensile strength materials means that the materials should not yield plastically during operation at the speed and temperature encountered during operation. For diameters larger than 3.0 inches, rotational speeds higher than 30,000 RPM and melt pour temperatures in excess of about 1500° K., 0.2% yield strengths in excess of 50,000 pounds per square inch at temperatures at or above 700° K. are recommended. The exact strength required will depend on the specific design of the atomizer and the operating conditions to which it will be subjected, as is well known to those familiar with the art of stress analysis. As the outer diameter or inner diameter of element 26 is increased, or as the speed of operation is increased, the tensile inertial stress generated within the element will also increase. The temperature of operation also must be considered since the strength of materials is known to be a function of the temperature of operation. As an example, we have found that a heat treated 410 stainless steel is suitable for element 26 when the outer diameter is 4.0 inches, the inner diameter is 2.8 inches, and the maximum temperature of the metal to be atomized is 2900° F. and the maximum speed of operation of the atomizer assembly is 36,000 RPM. For the same inner diameter, however, the maximum tensile inertial stress of a simple annular element 26 would approximately double if the outer diameter is increased from 4.0 inches to 6.0 inches at the same speed of operation. Those familiar with the art of heat transfer will also realize that the thermal gradient within element 26 can be controlled by controlling the thermal conductivity of the material. Thus, to reduce operating temperatures within element 26 it is preferable to use a material which is at the low end of the high thermal conductivity range. Our experience suggests that materials having a thermal conductivity of between 0.1 W/cm°K. and 0.5 W/cm°K. at 1000° K. are most preferred.

In the embodiment of FIG. 1 the element 24 has a base 34 and a radially inwardly facing frustoconical surface 36 tapering outwardly in the downward direction from the upper surface 21. The surface 36 and the upper surface 37 of the base 34 define a cavity within which the central element 22 is disposed. The central element 22 includes an outwardly facing frustoconical surface 40 which is contiguous with the surface 36 of the cavity along the interface 35. (The taper of the surfaces 36, 40 is exaggerated in the drawing.) To assemble these two pieces the element 24 is heated until the cavity expands radially to a dimension large enough to enable the central element 22 to be placed within the cavity. Upon cool down the central element 22 is placed in compression. In a similar manner, element 26 is shrunk fit over element 24, although the interface 33 is cylindrical rather than frustoconical.

During operation of the atomizer, a stream 42 of molten metal is poured onto the center of the spinning surface 21. The molten metal moves radially outwardly over the surface due to centrifugal force, whereupon it is thrown from the edge of the disk 12 in the form of tiny droplets which solidify to form metal powder particles.

A number of materials exist which may be suited for use in the present invention; selection must be made depending on the specific design of the disk and its elements, and on the specific operating conditions to which the disk will be subjected. For example, we believe that ceramics suitable for the central element would include (but would not be limited to) the oxide ceramics alumina, magnesia, and stabilized zirconia which have thermal conductivities of less than 0.1 W/cm°K. at 1000° K.; exact values depend on the purity, degree of porosity, and the method and accuracy of the measurement. Again depending on the specific size and design of the atomizer as well as intended operating conditions, the reinforcing ring or outermost element of the atomizer disk might be made from ferritic and martensitic stainless steels, such as 410, 420 and 440; from precipitation hardening stainless steels such as PH15-7; from iron-base nickel-chromium-molybdenum high strength alloys such as A-286 and D979; and from a variety of nickel-base superalloys such as Waspaloy, Udimet 500, Udimet 700, Inconel 700, Rene' 41, Astroloy, and others. The element or elements between the reinforcing ring and the central element may also be selected from a number of materials, some of which are molybdenum and several of its alloys, copper and several of its alloys, or aluminum and several of its alloys, which, in general, display thermal conductivities higher than 1.0 W/cm°K at 1000° K. When possible, it is particularly desirable to use low density materials for the outer ring or the elements between said ring and the central element in order to minimize the mass of the disk and to enable the disk to be larger in diameter or to achieve higher rotational speeds for a given level of inertial tensile stress. For some applications, suitable low density candidates for the outer ring would include several titanium alloys, while suitable low-density materials for the elements between said ring and the central elements would include several aluminum alloys.

Figure 2:
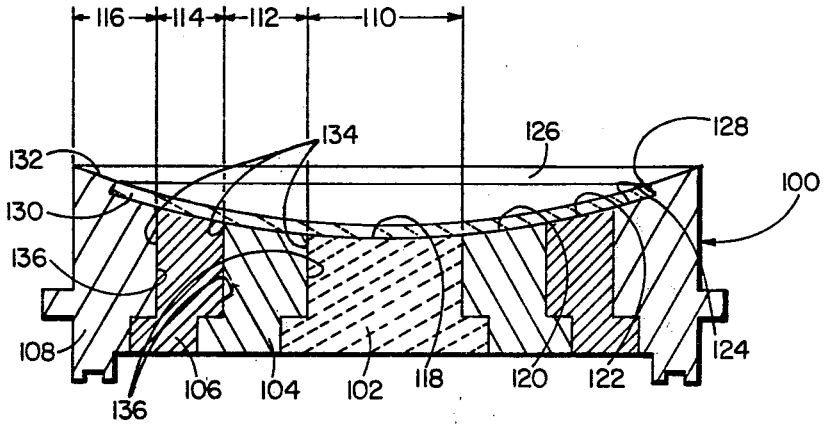
FIG. 2 is a sectional view of an atomizer disk according to another embodiment of the present invention.

FIG. 2 shows an atomizer disk 100 having another configuration within the scope of the present invention. In this embodiment the disk 100 is made from four separate concentric elements 102, 104, 106 and 108. These four elements define four contigous, concentric, radially aligned zones 110, 112, 114 and 116, respectively, of disk material. The upper surface 118 of the central element 102, and the annular upper surfaces 120, 122, and 124 of the surrounding elements 104, 106, 108, respectively, are coextensive and define the upper surface 126 of the disk 100. The upper surface 124 of the outer element 108 is stepped as at 128 to define a recess in the upper surface 126. That portion of the upper surface 126 within the recess is coated with a protective layer 130 of ceramic in a manner well known in the art. The radially outermost portion 132 of the upper surface 124 of the outer ring 108 is uncoated to assist in bonding, to the disk 100, a metal skull of the molten metal being poured.

Each succeedingly larger annular element 104, 106, 108 is shrunk fit onto the next smaller element of the disk 100 such that the downwardly extending, radially inwardly facing annular surface 136 of each disk element 104, 106, 108 is contiguous with a downwardly extending, outwardly facing annular surface 134 of a radially inwardly adjacent element 102, 104, 106, respectively.

As in the first embodiment, the central element 102 is made from a low thermal conductivity material, such a ceramic. The surroundng elements 104, 106, and 108 are made from high thermal conductivity material. The outermost element 108 is a reinforcing ring and must be made from a high tensile strength material. The elements 104, 106 between the reinforcing ring 108 and the central element 102 preferably have a thermal conductivity of at least 1.0 W/cm°K. at 1000° K. The four elements of the disk 100 are basically selected so as to tailor the thermal conductivity of the disk 100 at its surface 126 (i.e., the rate of conducting heat away from the molten metal being poured) to achieve the formation of a stable metal skull of appropriate thickness on the upper surface 126.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. Rotary atomization means for atomizing molten metal, including a drive shaft having an axis and a cylinder-like atomizer disk mounted on said drive shaft for rotation about said axis, said disk having an upper atomizer surface, the improvement comprising:

said disk comprising at least three elements concentric about said axis, each defining one of a similar number of contiguous, concentric, radially aligned zones of disk material, said concentric zones defining said upper atomizer surface, one of said elements being a central element and defining a central zone of said concentric zones and having a low thermal conductivity, said elements surrounding said central element being made from a high thermal conductivity material, the radially outermost of said elements also being made from a high tensile strength material.

2. The rotary atomization means according to claim 1 wherein said central element is ceramic, and the material of said elements between said outermost element and said central element has a thermal conductivity of at least 1.0 W/cm°K. at 1000° K.

3. The rotary atomization means according to claim 2 wherein the material of said outermost element has a thermal conductivity of between 0.1 and 0.5 W/cm°K. at 1000° K.

4. The rotary atomization means according to claim 2 wherein at least a portion of said atomizer surface includes a ceramic coating.

5. The rotary atomization means according to claim 4 wherein said radially outermost element has an annular upper surface defining the outermost portion of said upper atomizer surface, said outermost portion being free from said ceramic coating.

6. The rotary atomization means according to claim 1 wherein each of said elements has at least one annular surface extending downwardly from said upper atomizer surface, one of said downwardly extending annular surfaces of each element being contiguous with said downwardly extending annular surface of a radially adjacent element.

7. The rotary atomization means according to claim 6 wherein said element immediately surrounding said central element includes a base having an upwardly facing surface, said upwardly facing surface and said annular surface of said immediately surrounding element defining a cavity, said central element being disposed within said cavity.

8. The rotary atomization means according to claim 6 wherein said downwardly extending annular surface of said central element is frustoconical, tapering radially outwardly away from said atomizer surface.

* * * * *